United States Patent [19]

Depper

[11] Patent Number: 4,981,254

[45] Date of Patent: Jan. 1, 1991

[54] TOP STRUCTURE FOR A COLLAPSIBLE CARTON

[75] Inventor: John T. Depper, Alma, Ark.

[73] Assignee: Inland Container Corporation, Indianapolis, Ind.

[21] Appl. No.: 517,581

[22] Filed: May 1, 1990

[51] Int. Cl.[5] ..... B65D 5/46

[52] U.S. Cl. ..... 229/117.14; 229/117.13; 229/117.16

[58] Field of Search ..... 229/117.13, 117.14, 229/117.16, 117.17

[56] References Cited

U.S. PATENT DOCUMENTS

| | | | |
|---|---|---|---|
| 1,150,489 | 8/1915 | Bingaman . | |
| 1,856,729 | 5/1932 | Robinson | 229/117.13 |
| 1,909,898 | 5/1933 | Roland et al. | 229/117.13 |
| 2,284,283 | 5/1942 | Himes | 229/16 |
| 2,327,709 | 8/1943 | Himes | 229/39 |
| 2,396,168 | 3/1946 | Finn | 229/39 |
| 2,596,087 | 5/1952 | Shoudy | 229/117.13 |
| 2,655,304 | 10/1953 | Inman et al. | 229/39 |
| 2,676,750 | 4/1954 | Gastright | 229/39 |
| 2,741,399 | 4/1956 | Arneson | 220/113 |
| 3,057,535 | 10/1962 | Thompson | 229/39 |
| 3,058,585 | 10/1962 | Budd | 206/65 |
| 3,114,493 | 12/1963 | Dunkin | 229/34 |
| 3,521,741 | 7/1970 | Beaudry | 229/117.14 |
| 3,525,466 | 8/1970 | Robinson | 229/39 |
| 3,762,627 | 10/1973 | Ross, Jr. et al. | 229/37 R |
| 3,927,824 | 12/1975 | Razziano | 229/117.14 |
| 3,938,731 | 2/1976 | Ross, Jr. et al. | 229/54 R |
| 4,007,869 | 2/1977 | Stolkin et al. | 229/41 B |

FOREIGN PATENT DOCUMENTS

| | | | |
|---|---|---|---|
| 151145 | 4/1953 | Australia | 229/117.14 |
| 1189297 | 10/1959 | France | 229/117.14 |
| 1427854 | 1/1966 | France | 229/117.13 |
| 395751 | 7/1933 | United Kingdom | 229/117.13 |

*Primary Examiner*—Gary E. Elkins

*Attorney, Agent, or Firm*—Fitch, Even, Tabin & Flannery

[57] ABSTRACT

A carton having a tubular body is provided with an automatic, or nearly automatic, folding top construction, having triple-thickness handles at opposed ends of the carton, upstanding above the carton closure flaps. Two of the three thickness portions of the handles are hinged to the closure flaps and are automatically formed as the closure flaps are folded to a closed position. The remaining layer of the handles includes a hinged flap swung into position overlying the handle layers. As the third layer is swung into position, locking tabs carried by the third layer are received in recesses on the major closure flaps, thus locking the handles and the major closure flaps in a fully closed position.

6 Claims, 3 Drawing Sheets

FIG. 4
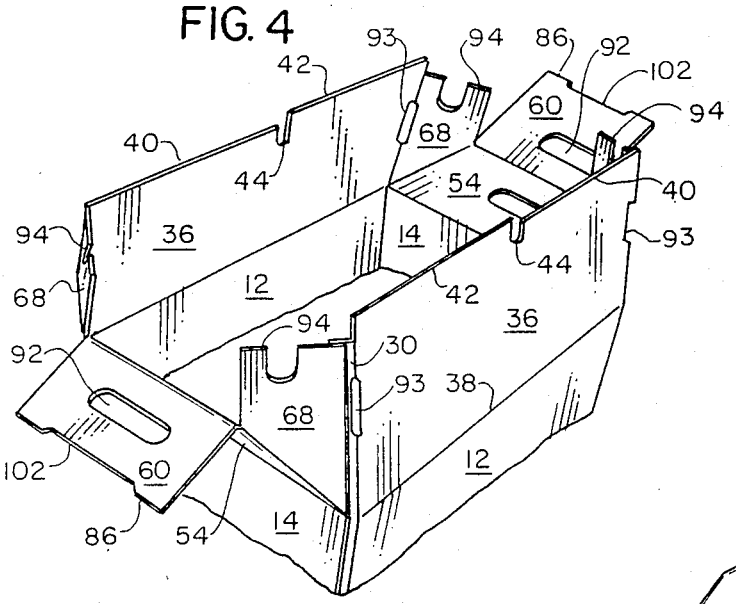
FIG. 5
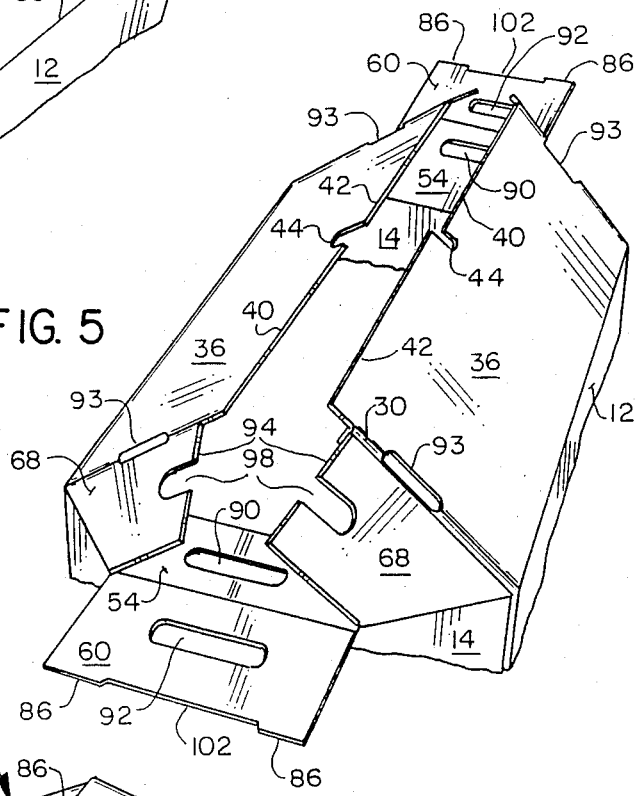
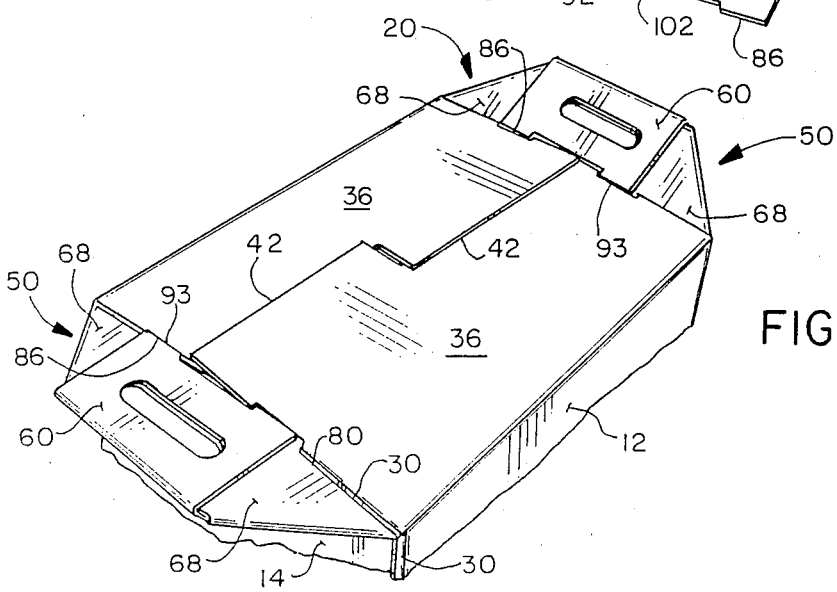
FIG. 6

TOP STRUCTURE FOR A COLLAPSIBLE CARTON

BACKGROUND OF THE INVENTION

1. Field of the Invention:

The present invention pertains to paper containers and, in particular, to paperboard or cardboard containers which are stored in a collapsed configuration.

2. Description of the Related Art:

Cartons made from paper products, such as paperboard and cardboard may be provided as a unitary sheet which has been formed by blanking and other operations by the carton manufacturer. Upon arrival to a consumer, a desired number of blanks can be erected, usually with one or more folding operations, using fasteners such as staples or adhesives as may be required. An advantage of such containers, in addition to their ease of shipment, is the reduced costs to a consumer since the consumer adds the value of erection.

However, some consumers prefer to use a partially fabricated container, one in which the carton manufacturer has applied one or more operations on a flat blank. For example, U.S. Pat. No. 2,396,168 and 2,676,750 disclose collapsible cartons in which a flat or planar blank is folded and certain portions thereof secured together with adhesive. These cartons are collapsed for storage and shipment to a consumer at a remote location. U.S. Pat. No. 3,525,466 is similar to the carton of U.S. Pat. No. 2,676,750 in that the carton blank is secured at the ends thereof with adhesive to form a tube. As a further example, U.S. Pat. No. 3,525,466 illustrates a six-sided tube, forming a container with six sidewalls and hexagonal endwalls, while U.S. Pat. No. 2,676,750 provides four sidewalls, producing a container with a rectangular cross-section.

Partially erected cartons can be shipped in a "flat" or collapsed tubular configuration with only a simple manipulation being required of a consumer to open the tube into a carton receptacle. Typically, a multiple section bottom is provided with adhesive securements among several sections so that the bottom can be unfolded and automatically positioned with simultaneous extension or opening of the sides of the carton. Further, this opening and erection of the carton can be accomplished in one continuous operation. Examples of such carton bottom constructions may be found in U.S. Pat. Nos.: 2,284,283; 2,327,709; 2,655,304; 2,741,399; 3,057,535; and 4,007,869. The cartons described in many of these patents provide a rapid and simple construction of an open top receptacle, but an automatically closing carton top has not been provided, and there has been a need in the art to provide this type of carton top construction, which can be automatically erected in a single, simple operation.

Further, it is desirable to also provide a secure locking of the carton top to prevent unintentional opening. For example, U.S. Pat. Nos. 1,150,489 and 3,058,585 disclose cartons having slotted top panels which interlock, but such constructions are not employed in automatically closing carton top arrangements.

U.S. Pat. Nos. 3,114,493 and 3,938,731, like many of the cartons referred to above, provide handles or hand holes aiding in the easy portability of the cartons, especially when filled with a relatively heavy product. U.S. Pat. No. 3,938,731, for example, provides a receptacle for use with a manual trash compactor, the compacted trash stored in the receptacle can at times be quite heavy, owing to the increased density resulting from compaction. In one embodiment, illustrated in FIGS. 15 and 16, a double thickness handle portion is provided upstanding from the closed carton top. The carton is however not of a locking type, and a strip of sealing tape is provided to maintain the carton top in a closed position, with the layers of the handles properly aligned to provide registration of the hand holes.

SUMMARY OF THE INVENTION

Accordingly, it is an object, according to the present invention, to provide a carton top construction for a collapsible carton, which automatically locks together during unfolding and which can be erected with a few simple manipulations.

A further object, according to the present invention, is to provide a top structure for a collapsible carton having interlocking cover panels.

Another object, according to the present invention, is to provide a top structure for a collapsible carton having upstanding handles extending above the cover panels.

Yet another object, according to the present invention, is to provide a carton of the above-described types in which the top structure is quickly and automatically formed without requiring fasteners such as sealing tape, staples or the like.

These and other objects, according to the present invention, which will become apparent from studying the appended description and drawings, are provided in a carton comprising:

(a) a tubular body with opposed endwalls between a pair of opposed sidewalls, the tubular body surrounding a carton interior having a top opening, (b) a bottom wall, (c) a pair of opposed cover flaps closing the top opening of the carton, and (d) upstanding handle means at opposite ends of the carton extending above the cover flaps, each handle means including:

(1) a first panel defining a handhole, the first panel extending from an endwall and having an upper edge remote from the endwall;

(2) a pair of reinforcing panels extending from the top panels to overlie said first panel, and cooperating to define a hand hole in registry with the first panel hand hole; and (3) a locking flap defining a hand hole extending from the upper edge of the first panel so as to be foldable over the reinforcing panels and said locking flap having locking means for locking to said cover flaps to maintain the locking flap and the cover flaps in fixed positions.

BRIEF DESCRIPTION OF THE DRAWINGS

In the drawings, wherein like elements are referenced alike;

FIGS. 4—6 are fragmentary perspective views showing the assembly operation of the carton top construction.

DETAILED DESCRIPTION OF THE PREFERRED EMBODIMENT

Figure 1:
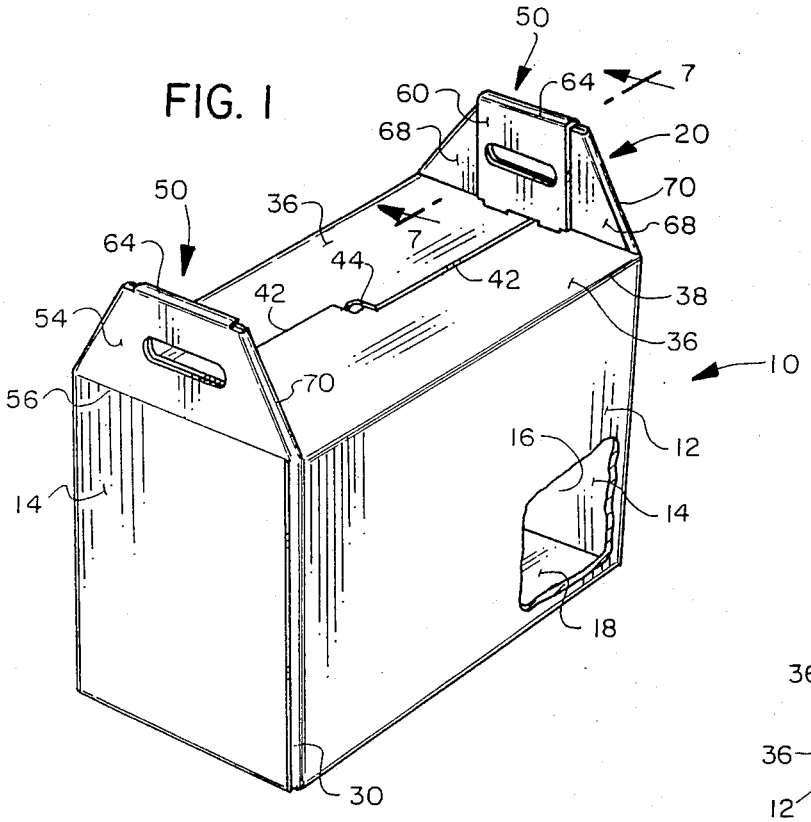
FIG. 1 is a perspective view of a fully erected carton illustrating the top structure according to principles of the present invention.
Figure 7:
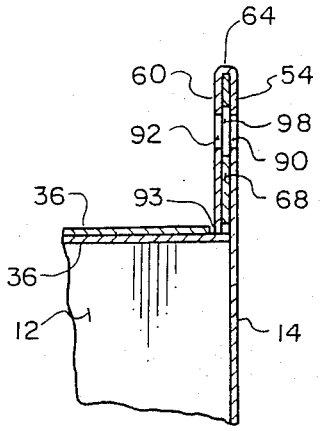
FIG. 7 is a fragmentary cross-sectional view taken along the lines 7—7 of FIG. 1.

Referring now to the drawings, and initially to FIG. 1, a carton generally indicated at 10 includes a pair of opposed sidewalls 12 and a pair of opposed endwalls 14. Together, the sidewalls and endwalls define a tubular body enclosing an interior volume 16. A bottom means 18 encloses the bottom of interior 16, while a carton top construction generally indicated at 20 encloses the top of the interior 16. Any suitable bottom wall enclosing the bottom of the carton interior may be used and the bottom need not necessarily comprise the folded flaps illustrated in FIG. 3.

Figure 2:
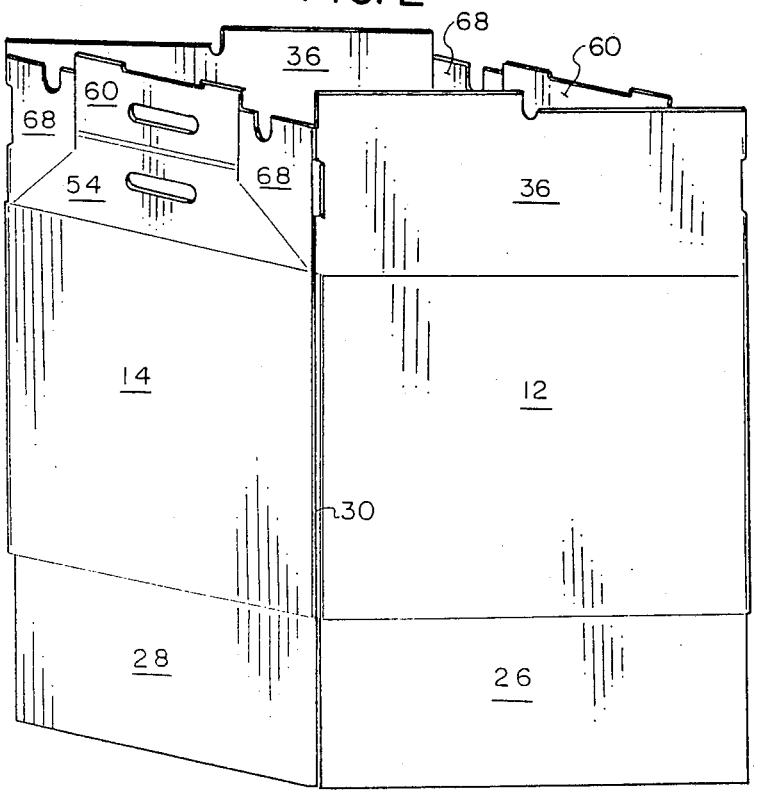
FIG. 2 is a perspective view of the carton of FIG. 1 in a folded or collapsed configuration.
Figure 3:
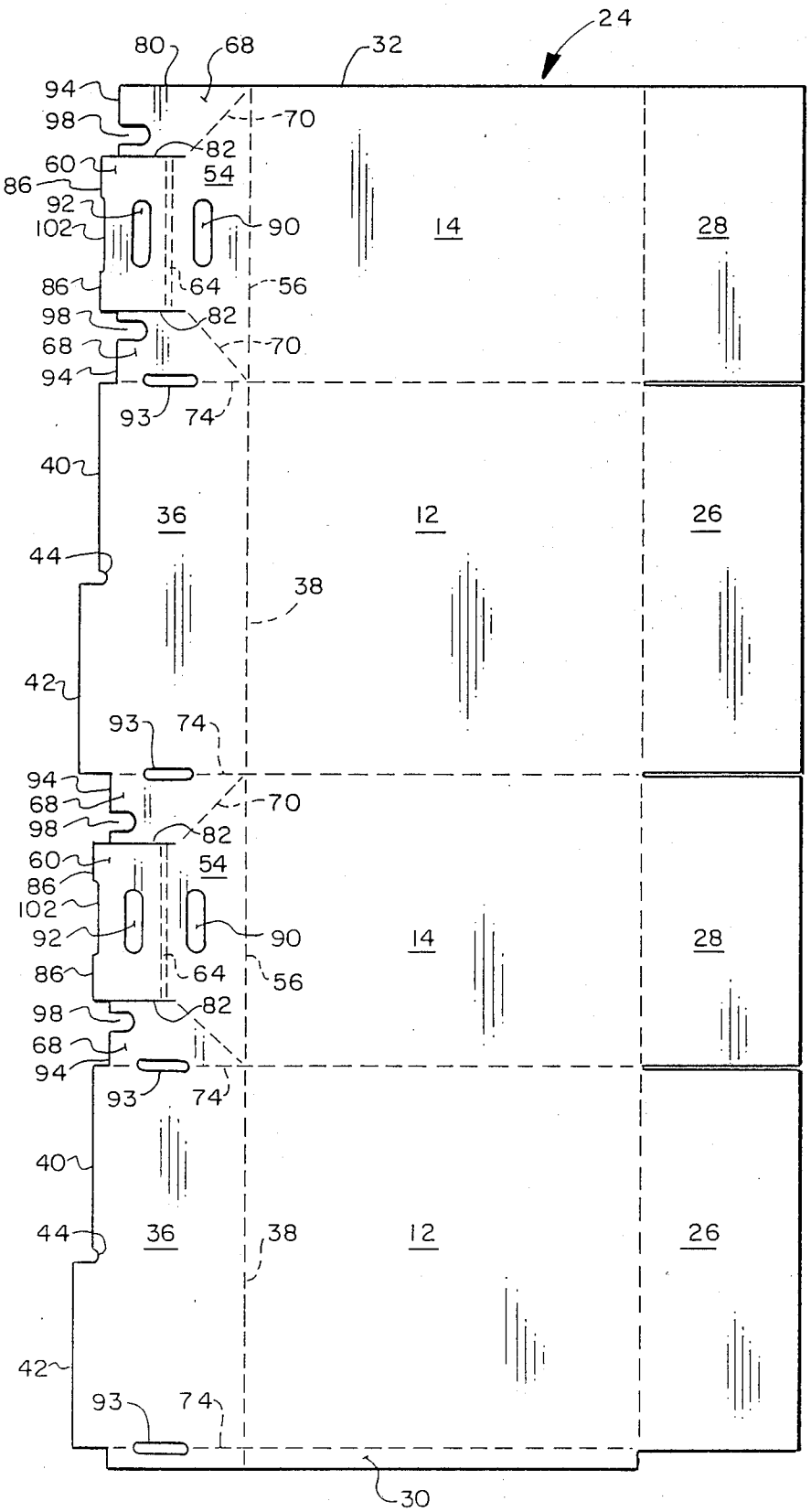
FIG. 3 is a plan view of the blank thereof.

Referring to FIG. 3, a carton blank generally indicated at 24 is shown. The blank 24 includes generally rectangular bottom panels 26 and 28 extending from the carton sidewalls and endwalls, respectively. The bottom flaps 26, 28 are shown to provide a complete example of a carton blank. As will be seen herein, the carton top construction of the present invention provides numerous advantages when used with collapsed, automatically opening cartons. Accordingly, a self-locking, quick set-up, bottom construction, such as that illustrated in U.S. Pat. Nos. 3,057,535 or 2,655,304, may be employed, and U.S. Pat. Nos. 3,057,535 and 2,655,304 are herein incorporated by reference as if fully set forth herein, for this purpose. The carton top construction may also be used with other carton bottom construction, such as the simple rectangular flaps of FIGS. 2 and 3.

As mentioned above, the sidewalls 12 and endwalls 14 together comprise a tubular body. With reference to FIG. 3, the tubular body is formed by securing a joint flap 30, located adjacent one sidewall 12, to an edge 32 of an endwall 14 with adhesive, to form a "manufacturer's joint." with the formation of the manufacturer's joint, the carton may be collapsed or folded in a flat configuration, as illustrated in FIG. 2. The collapsed configuration provides advantages in storage and transport.

Referring again to FIG. 3, cover panels or flaps 36 extend from sidewalls 12 and are joined thereto along hinge or fold lines 38. According to one aspect of the present invention, the cover flaps 36 include stepped free edges 40, 42 joined together by a recess portion 44. As can be seen in FIG. 3, the marginal edges 42 of the cover panels are slightly outset from the marginal edges 40, being spaced a slightly greater distance from fold line 38. An economical manufacture results from the substantially identical construction of the top cover flaps 36 of the preferred embodiment. As illustrated in FIG. 1, the recess portions 44 of the cover flaps 36 interlock to provide a secure closure, with the marginal edges 42 of one cover panel 36 overlying the marginal edge 40 of the other cover flap. The cover panels are hingedly connected to portions of the carton top construction which help to guide the cover panels to their interlocking position.

Referring again to FIG. 1, handle means, generally indicated at 50, are provided at each end of carton 10. The handle means 50 include registered hand holes which are formed in the various thickness or layers of the handle Constructions. Referring additionally to FIGS. 4–6, the handle means 50 includes a first, generally trapezoidal panel 54 extending from endwall 14 and hingedly joined thereto with a hinge or fold line 56. A generally rectangular fold-over or locking flap 60 extends from the upper edge of trapezoidal panel 54 and is joined thereto with a fold or hinge line 64. Partially visible in FIG. 1 are the medial reinforcing panels 68 joined to the diagonal edges of trapezoidal panel 54 by hinge or fold lines 70. Thus, each handle means 50 is comprised of three overlapping handle layers which are formed and interlocked so as to cooperate in maintaining the closed configuration of the carton, as illustrated in FIG. 1.

Referring again to FIG. 3, the trapezoidal panels 54 are joined to the upper edges of endwalls 15 by hinge or fold lines 56. The locking flaps 60 are, in turn, joined to the trapezoidal panels 54 with fold or hinge lines 64. Extending on opposite sides of locking flap panel 60 are reinforcing panels 68, joined by fold or hinge lines 70 to the diagonal edges of trapezoidal panel 54. According to one aspect of the present invention, the reinforcing panels 68 are also joined by fold or hinge lines 74 to opposed edges of cover panels 36.

As can be seen at the lower end of FIG. 3, the joint flap 30 extends across one edge of cover panel 36, and is joined to a base edge 80 of reinforcing panel 68, located at the opposite end of the blank (see FIG. 2, also) The upper edges 82 of reinforcing panel 68 are cut free of the opposed edges of locking flap 60. According to another important feature of the present invention, locking tabs 86 extend from the free edges of fold over panels 60. As will be seen herein, the locking tabs 86 are received in cutouts or recesses 93 formed in the opposed edges of cover panels 36, along hinge or joint lines 74.

With reference again to FIG. 3, the trapezoidal panels 54 and fold over panels 60 define hand hole cutouts 90, 92, respectively. The cutouts 90, 92 are arranged such that, when the the trapezoidal panels and fold over panels are laid one on top of the other by folding at hinge or fold line 64, the hand holes are aligned in registry. The reinforcing panels 68 define a free, mating edge 94 disposed adjacent the locking tabs 86, and recesses 98 are formed in the mating edges 94 of reinforcing panels 68. When mating edges 94 are either butted or positioned close together, the recesses 98 are arranged opposite one another and together combine to form a hand hole aligned in registry with the aforementioned hand holes 90, 92.

With reference now to FIGS. 4–6, erection of the carton top construction 20 will now be described. Initially, the carton 10 is provided in the configuration illustrated in FIG. 2, the manufacturer's joint having been formed with a suitable adhesive to provide a flat, tubular package, with the components of the carton top construction extending coplanar with the sidewalls and endwalls of the collapsed tubular body. Erection of the carton is commenced by opening the collapsed tube bringing the sidewalls and endwalls 12, 14 into a rectangular configuration, thus opening the carton interior which is surrounded by the endwalls and sidewalls. At this point of the carton erection, the panels of the carton top construction are aligned coplanar with the walls of the rectangular tubular body, the panels of the carton top construction forming an open top through which the interior may be filled. An automatic locking bottom may be provided, as explained above, with the bottom wall of the carton being fully formed at the time the sidewalls and endwalls of the tubular body are fully expanded to an open, rectangular configuration.

As can be seen with reference to FIG. 3, the top portion of the carton blank, that portion extending beyond the fold lines 38, 56, is continuously joined end-toend, assuming completion of the manufacturer's joint. Initially, therefore, the cover panels and various layers forming the handle means also assume a rectangular tubular configuration as coplanar extensions of the sidewalls and endwalls of the carton. Inwardly directed pressure is applied to the reinforcing panels 68, forcing the panels to bend along fold lines 70, bringing the mating edges of the reinforcing panels toward the trapezoidal panel 54.

With folding of the reinforcing panels 68, the cover panels 36 are swung about their hinge lines 38 to enclose the top of the carton interior. With continued pressure applied to the reinforcing panels and perhaps the cover panels, the extended edges 42 of the cover panels are brought to overlie the inset free edges 40, and the recesses 44 are interlocked in the manner illustrated in FIG. 6. The mating edges 94 of the reinforcing panels 68 are brought into contact with the trapezoidal panel 54 and are placed immediately adjacent or abutting one another, the recesses 98 thereby being brought into registry with the hand holes 90 of the trapezoidal panels.

Thereafter, the locking panels 60 are placed over the opposed portions of their respective pairs of reinforcing panels 68. Hand holes 92 formed in the locking panels are brought into registry with hand holes in the trapezoidal panel and the hand hole formed by cooperation of the reinforcing panels. If desired, the handle means 50 may be folded outwardly in the manner illustrated in FIG. 6, or the handle means can be left in an upright position, such as that illustrated in FIG. 1. Thereafter, the fold over flap 60 is swung about its hinge line 64 and brought into contact with the reinforcing panels, thereby bringing the locking tabs 86 into the locking recesses 93 formed in opposed side edges 95 of the cover flaps 36, securing the fold over flap and the reinforcing flaps from springing open.

In the preferred embodiment, the fold over flap 60 is configured to overlie substantially the entire rectangular central portion of the trapezoidal panel 54, leaving triangular end portions of double layer thickness The interlocking of recesses 44 and the locking of tabs 86 in recesses 93 have been found to provide surprising reliability in the locking of the cover flaps, and in maintaining the multi-layer configuration of the handle means. In the fully locked configuration, the central portion 102 of the locking flap free edge presses against both cover flaps 36, maintaining the cover flaps in a fully closed position with recesses 44 securely interlocked. As will now be appreciated, the locking flap 60 is wedged against the cover flaps 36, thus placing the trapezoidal panel 54 in tension. The locking tabs 86 maintain wedging of the flap 60, preventing dislocation of the flap 60, which would otherwise leave the interlocking of notches 44 as the sole retention of cover flaps 36.

As can now be seen, the present invention provides a carton top construction which provides a fully opened top for a carton body, with portions of the carton top construction forming coplanar extensions of the carton sidewalls. Further, the carton top construction is quickly and easily erected with a few relatively simple manipulations. For example, as has been described above with reference to FIGS. 4–6, the carton top is erected by closing the cover flaps 36, this action completing erection of two of the three layers of handles 50. Thereafter, the locking flaps 60 are swung into a locked position, locking the handles and the major flaps 36 in a closed position.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton comprising:

(a) a tubular body with opposed endwalls between a pair of opposed sidewalls, the tubular body surrounding a carton interior and defining a top opening, (b) a bottom wall, (c) a pair of opposed cover flaps closing the top opening of the carton, and (d) upstanding handle means at opposite ends of the carton, extending above the cover flaps, each handle means including:

(1) a first panel defining a handhole, the first panel extending from an end wall and having an upper edge remote from the end wall;

(2) a pair of reinforcing panels extending from the top panels to overlie said first panel, and cooperating to define a hand hole in registry with the first panel hand hole; and (3) a locking flap defining a hand hole extending from the upper edge of the first panel so as to be foldable over the reinforcing panels and said locking flap having locking means for locking to said cover flaps to maintain the locking flap and the cover flaps in fixed positions.

2. The carton of claim 1 wherein the cover flaps have opposed edges defining notches for interlocking interengagement, one with the other, to hold the cover flaps in a closed position covering the carton interior.

3. The carton of claim 1 wherein the locking flap locking means comprises a lower edge of the locking flap wedged against the cover panels to maintain the cover panels in a closed position, and tabs extending from the locking flap lower edge, receivable in recesses formed in the cover panels to prevent dislocation of the locking flap from the wedging position.

4. The carton of claim 1 wherein the first panel is trapezoidal, the reinforcing panels cooperate to form a trapezoidal configuration, and the locking flap is generally rectangular and dimensioned to overlie a central portion of the reinforcing panels without extending therebeyond.

5. A carton having a tubular body with a pair of opposed endwalls and a pair of opposed sidewalls, generally rectangular end panels extending from the endwalls and generally rectangular side panels extending from the side walls, the end panels being foldable to form upstanding handle means with each handle means including three overlapping handle layers, each end panel including:

a first generally trapezoidal panel portion defining a handhole, extending from an end wall and having an upper edge remote from the end wall;

a pair of reinforcing panels on opposite sides of the trapezoidal panel portion, and hingeably joined thereto so as to abut one another to define a hand hole in registry with the hand hole of the trapezoidal portion when folded thereover; and a locking flap portion hingeably joined to the trapezoidal panel, between the reinforcing panels, so as to be foldable over said reinforcing panels, said locking flap portion having locking means for locking to said cover flaps and defining a handhole aligned in registry with the hand holes of said reinforcing panels when folded thereover.

6. A blank for a carton having a tubular body surrounding a carton interior and defining a top opening, with a pair of opposed cover panels closing the top opening of the carton, and upstanding handle means at opposite ends of the carton, extending above the cover flaps, each handle means including three overlapping handle layers, the carton blank comprising:

a serial succession of a pair of endwalls interposed between a pair of sidewalls;

generally rectangular cover panels joined by hinge means to the side walls, the cover panels including a free edge remote from the sidewalls and located between a pair of opposing side edges which define locking apertures therein; and generally rectangular end panels extending from the endwalls, each end panel including:

a first generally trapezoidal panel portion defining a handhole, joined with hinge means to the end wall and having an upper edge remote from the end wall;

a pair of reinforcing panels joined with hinge means to opposite sides cf the trapezoidal panel portion, the reinforcing panels having generally colinear free edges extending generally parallel to the base of the generally trapezoidal panel portion, said reinforcing panels defining recesses at their free edges which cooperate when folded over the trapezoidal portion to define a hand hole in registry with the hand hole of the trapezoidal portion;

hinge means joining the reinforcing panels to opposed side edges of the cover panels, and a locking flap between the reinforcing panels, joined by hinge means to the trapezoidal panel so as to be foldable over said reinforcing panels, said locking flap having a free edge extending above the colinear free edges of the reinforcing panels, and tab means extending from the free edge of the locking flap so as to be received in said locking apertures.

* * * * *